US006502802B2

(12) United States Patent
Jorn et al.

(10) Patent No.: US 6,502,802 B2
(45) Date of Patent: Jan. 7, 2003

(54) DOUBLE BIAS CORNER FORM

(75) Inventors: Larry Jorn, St Clive, IA (US); Robert McCracken, Urbandaie, IA (US)

(73) Assignee: Wilian Holding Company, Des Moines, IA (US)

( * ) Notice: Subject to any disclaimer, the term of this patent is extended or adjusted under 35 U.S.C. 154(b) by 55 days.

(21) Appl. No.: 09/792,744

(22) Filed: Feb. 23, 2001

(65) Prior Publication Data

US 2002/0116888 A1 Aug. 29, 2002

(51) Int. Cl.[7] ..... E04G 9/00

(52) U.S. Cl. ..... 249/194; 249/192; 249/44; 249/33

(58) Field of Search ..... 249/18, 26, 33, 249/44, 47, 192, 194, 210, 188, 189; 52/282.3

(56) References Cited

U.S. PATENT DOCUMENTS 3,662,985 A * 5/1972 Parker ..... 249/219
4,520,988 A * 6/1985 Walker ..... 249/13
5,044,601 A * 9/1991 Miller ..... 249/194
5,456,444 A * 10/1995 Wegman ..... 249/40
6,322,043 B1 * 11/2001 Saervoll ..... 249/44
6,419,204 B1 * 7/2002 Flathau ..... 249/194

* cited by examiner

*Primary Examiner*—Carl D. Friedman
*Assistant Examiner*—Jennifer I. Thissell
(74) *Attorney, Agent, or Firm*—Kent A. Herink; Davis Brown Law Firm

(57) ABSTRACT

A corner form assembly for forming inside corners of concrete structures. A pair of double bias form components, each of which has an acute angle between a side rail and the face sheet are arranged with the side rails in contact engagement to form a form assembly with an inside angle equal to twice the acute angle of the side rails. A reverse bias coupler is used to join the double bias form components with conventional wall form panels having 90° end rails. The corner assembly acts to release the forces imposed on the components by the poured concrete upon disassembly and so allows the components to be readily stripped from the poured wall.

4 Claims, 2 Drawing Sheets

DOUBLE BIAS CORNER FORM

BACKGROUND OF THE INVENTION

1. Field of the Invention

The invention relates generally to apparatus used in forming concrete structures and, more specifically, to a concrete forming apparatus for use in forming corners of a concrete structure.

2. Background of the Prior Art

Concrete forming apparatus is in wide use in the construction of buildings, bridges, and other concrete structures. A common system for forming concrete structures uses a plurality of form components that are adapted to be assembled into a wide variety of configurations to conform to virtually any architectural requirement. Such forming apparatus components are typically made of metal so that they are strong enough to support the heavy weight of poured concrete and durable so that the components can be reused many times.

One of the configurations that is most frequently encountered in constructing concrete structures is the right angle corner. To form a wall having a corner, two sets of forms must be constructed, an inside corner form and a corresponding outside corner form that is spaced from the inside corner form by the thickness of the wall to be formed between the two forms. Once the concrete has been poured and has set sufficiently, the forms must be stripped from the wall. This usually does not present a problem on the outside corner form where there is sufficient room to separate the form components and release them from the wall. On the inside corner form, however, the form components frequently are difficult to disassemble and release from the wall because of the inside corner geometry and because of the pressure that is exerted on the forms by the poured concrete.

Another issue faced in the forming of concrete wall corners is that long runs of concrete form assemblies will often meet at a corner where the form components must fit together with close tolerances. During the actual construction of a concrete structure, there are inevitably variations in the assembly of the components and preparation of the site that must be accommodated. Conventional corner forming apparatus have required the use of hand-built spacers or shims. These are time-consuming and can require a relatively high level of skill to build. Additionally, the hand-built spacers or shims frequently cannot be reused and so must be constructed anew each time the forms are reset.

One approach to forming corners has been the use of form components that are fabricated with the predetermined angle, most commonly a right angle (90°). These form components suffer from the disadvantage of having a shape that prevents them from laying flat during shipping and storage. Further, such fabricated corner forms cannot be stripped from an inside corner until the adjacent form components have been removed.

It is advantageous to have the ability to interconnect the various components of the corner forming apparatus in a wide variety of configurations without unduly multiplying the number of distinct components that are required to assemble the corner forming apparatus of the desired diversity of dimensions and which will readily accommodate the typical range of variations found in the field.

SUMMARY OF THE INVENTION

The invention consists of a double bias form component used in forming a corner of a concrete structure. The component consists of a form panel that has a flange attached to a side portion of the face sheet at a predetermined acute angle inwardly toward the center of the form component and a corresponding flange attached at the opposing side portion also at the predetermined acute angle inwardly toward the center of the form component, thereby providing a trapezoidal cross-section. Two of the components are assembled at an angle relative to each other that is twice that of the predetermined angle by placing a flange of one component in facing engagement with a flange of the second component. The outwardly extended legs of the assembled form components, which present the predetermined acute angles, are mated to the 90° components of conventional wall forms by a reverse bias coupler which has a flange at an angle that is supplementary to the predetermined acute angle on one side and a 90° face on the opposite side. Because the adjacent flanges can be slid relative to each other by a the inside corner form apparatus can be readily stripped from the poured concrete wall. The predetermined angle is preferably 45°, so that the corner formed is a right angle corner, but any desired angle could be used to construct corners having angles other than right angles.

An object of the present invention is to provide a form apparatus for forming corners of a concrete structure wherein a pair of identical components can be assembled to make an inside corner form that can be integrated with conventional wall form components.

Another object of the invention is to provide a form apparatus for forming corners of a concrete structure which can be easily and readily stripped from the formed wall.

A further object of the invention is to provide a form apparatus for forming corners of a concrete structure which can be shipped and stored flat to conserve space and which are provided in a limited range of dimensions to allow selection in the field to reduce the need for hand-built spacers or shims without requiring a large inventory of components.

These and other objects of the invention will be made apparent to those skilled in the art upon a review and understanding of this specification, the associated drawings, and the appended claims.

DETAILED DESCRIPTION OF PREFERRED EMBODIMENTS

Figure 1:
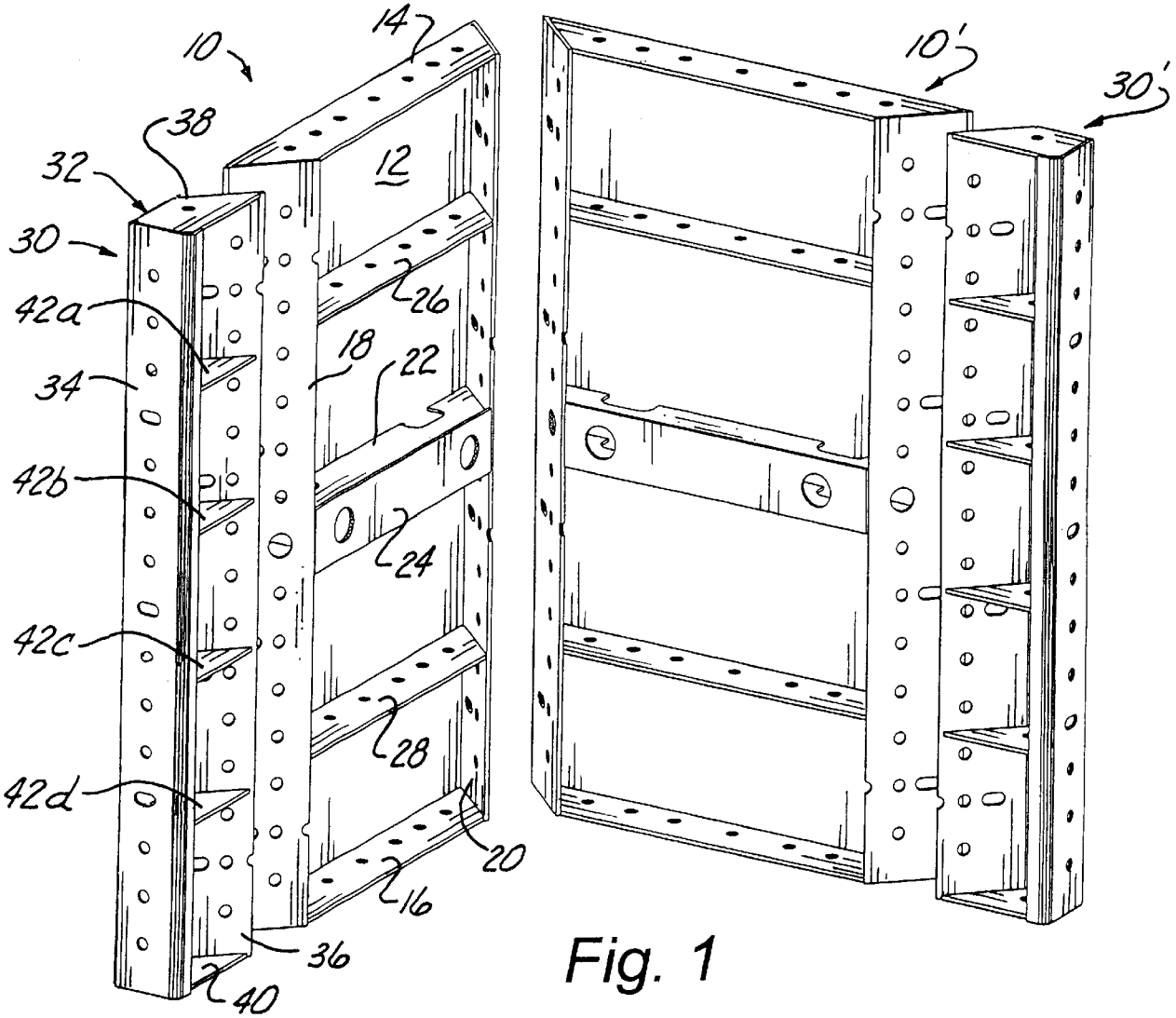
FIG. 1 is a perspective view of a pair of double bias corner forms and reverse bias couplers of the present invention.

Referring to the drawings, there is illustrated in FIG. 1, generally at 10, a double bias form component of the present invention, which includes a rectangular face sheet 12 and a pair of end. rails 14 and 16 that extend rearwardly from the top and bottom edges of the face sheet 12 and are secured to the face sheet 12 by weldments or the like. The end portions of the end rails 14 and 16 are angled inwardly at a predetermined angle and so have a trapezoidal shape. A pair of rectangular side rails 18 and 20 are secured by weldments or the like along a longitudinal edge to a side edge of the face sheet 12 and tilted inwardly at the predetermined angle. Accordingly, the ends of the side rails 18 and 20 are adjacent the corresponding ends of the end rails 14 and 16 and are secured thereto by weldments or the like.

A central brace 22 having the same trapezoidal shape as the end rails 14 and 16 is secured to the back side of the face sheet 12 centrally of the end rails 14 and 16. Its ends are secured to the side rails 18 and 20 by weldments or the like. Positioned over the central brace 22 is a rectangular brace panel 24 that is secured at it end portions by weldments or the like to the side rails 18 and 20. Further bracing the form 10 are a pair of cross braces 26 and 28 spaced between the central brace 22 and the end rails 14 and 16, respectively.

A spanning member, indicated generally at 30, is used in combination with the double bias form 10. The spanning member 30 has a rectangular face sheet 32 that is the same length or height as the face sheet 12 of the double bias form 10. It includes a 90° side rail 34 that is secured along a longitudinal edge to a side of the face sheet 32 and extended rearwardly therefrom at a 90° angle. A bias side rail 36 is secured to the face sheet 32 along the opposing side thereof and extended rearwardly and inwardly at a an angle that is supplementary to the predetermined angle of the double bias form 10. A pair of end panels 38 and 40 are secured to the end portions of the face sheet 32, the 90° side rail 34 and the bias side rail 36, one at each end of the spanning member 30. Bracing of the spanning member 30 is provided by four ribs 42*a–d* which are the same shape as the end panels 38 and 40 and which are secured to the back of the face sheet 32 and the side rails 34 and 36.

In use, two pair of the double bias forms 10 and the reverse bias couplers 30 are used to construct a corner form. The pair of double bias forms 10 and 10' are arranged with the side rail 20 of the form 10 aligned with and in contact engagement with the side rail 18' of the form 10'. Connectors, such as nut and bolt combinations, are inserted in aligned holes in the side rails and tightened to secure the two forms 10 and 10' to each other. A spanning member 30 is positioned adjacent to the form 10 with its bias side rail 36 aligned and in contact engagement with the side rail 18 of the form 10. Again, connectors, such as nut and bolt combinations, are inserted into aligned openings in the two members and tightened to secure the spanning member 30 to the double bias form 10. In a similar manner, spanning member 30' is releasably attached to double bias form 10'. This assembled corner form is then used in combination with other modular concrete form components to assist in the formation of inside corners.

Figure 3:
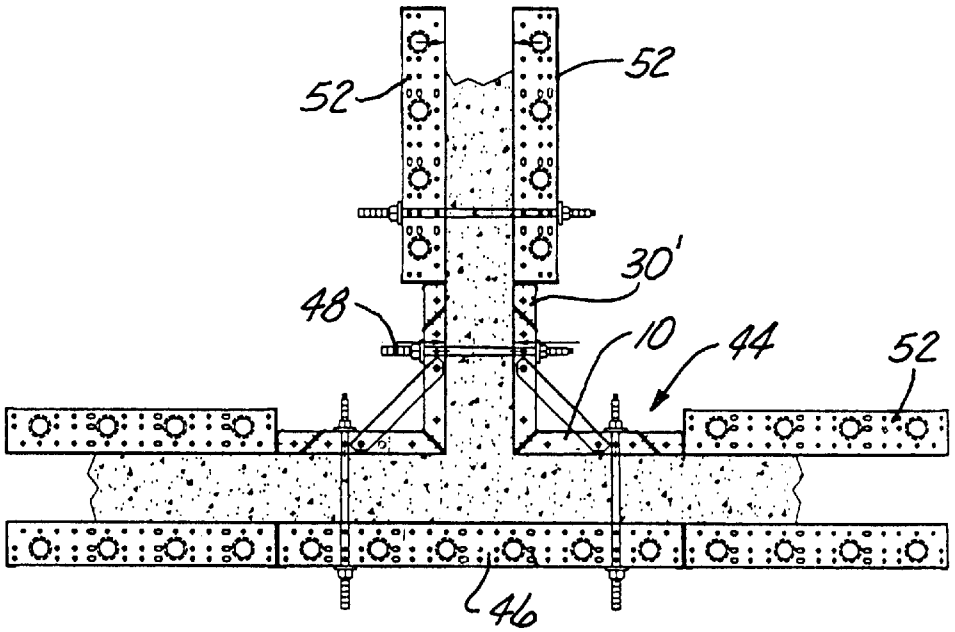
FIG. 3 is a plan view of the a corner form assembly used in combination with other modular concrete form components to construct a T-shaped wall section having two inside corners.
Figure 2:
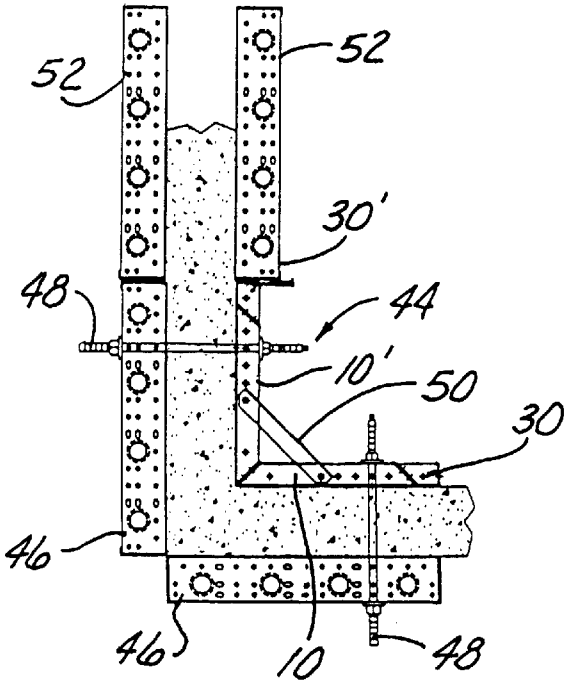
FIG. 2 is a plan view of the a corner form assembly used in combination with other modular concrete form components to construct a corner.

Four embodiments of the invention assembled to form inside corners in concrete structures are illustrated in FIGS. 2 and 3. In FIG. 2, The assembled corner form, referred to generally as 44, is spaced apart from a pair of wall form panels 46 by a pair of tie rods 48. Additionally, a corner brace 50 has been added to further strengthen the assembly. Additional wall form panels 52 are placed in contact engagement with the 90° side rails of the reverse bias couplers to form the extension of the walls beyond the corner form assembly 44. Fresh or liquid concrete is poured in the assembly and allowed to set, whereupon the forms can be stripped. Since there is an acute angle of the double bias forms 10 and 10' at the contact with the reverse bias couplers 30 and 30', release of the nut and bolt combinations between the two form components will allow the reverse bias couplers 30 and 30' to move in a direction away from the poured wall and toward the inside corner, thereby allowing the corner form assembly to be stripped from the poured wall. In conventional corner systems, there is a 90° angle, and the pressure exerted on the form components by the poured concrete very often puts a binding force on the components that prohibits them being stripped from the wall until the wall form panels have been removed or unless a very great amount of force is used to dislodge the components.

In FIG. 3, a pair of the corner form assemblies 44 are used to assist in the formation of a pair of inside corners, resulting in a wall section that extends laterally from another wall section. Note that the dimensions of the double bias corner forms used in the assemblies 44 is different than that illustrated in FIG. 2. While the reverse bias couplers 30 may be stocked in inventory of only a single size, by utilizing double bias forms of diverse dimension, corners can usually be formed without the use of filler strips or shims.

In the preferred embodiments used in the drawings, the angles between the face sheet 12 and the side rails 18 and 20 are 45°. This results in a corner form assembly 44 that is used to form right angle (90°) corners. Of course, it will be appreciated that other predetermined angles could be used, and further that the angles of the side rails do not have to be identical. For example, if the angle between the side rail 18 and the face sheet 12 remained at 45°, but the angle between the side rail 20 and the face sheet 12 was increased to 55°, the same reverse bias couplers could be used and the modified double bias form could now be used to form corners having an angle of 110°; altematively, a 45° form 10 could be used with the modified 55° form to construct corners having an angle of 100°. Similar changes could be made to form inside corners of any desired angle.

Although the invention has been described with respect to a preferred embodiment thereof, it is to be also understood that it is not to be so limited since changes and modifications can be made therein which are within the full intended scope of this invention as defined by the appended claims.

We claim:

1. A corner form apparatus, comprising:

(a) a pair of double bias form components having a trapezoidal cross-section, comprising a face sheet having a pair of opposing side portions, a first flange extended from a first side portion of the face sheet rearwardly and inwardly at a predetermined angle, and a second flange extended from a second side portion of the face sheet rearwardly and inwardly at the predetermined angle;

(b) a pair of reverse bias couplers, comprising a face sheet having a pair of opposing side portions, a flange extended from a first portion of the face sheet rearwardly and outwardly at an angle supplementary to the predetermined angle, and an end wall extended from a second side portion of the face sheet rearwardly at a 90-degree angle;

(c) connectors releasably securing a first flange of a first of the double bias form component in contact engagement with a first flange of the second of the double bias form components arranging the face sheets of each of the double bias form components at an angle twice that of the predetermined angle; and (d) connectors releasably securing the second flange of the first double bias form component in contact engagement with the flange of the first reverse bias coupler arranging the face sheets to be coplanar and releasable securing the second flange of the second bias form component in contact engagement with the flange of the second reverse bias coupler arranging the face sheets to be coplanar.

2. A corner form apparatus as defined in claim 1, wherein the face sheets of the double bias form components are rectangular.

3. A corner form apparatus as defined in claim 1, wherein the predetermined angle is 45-degrees.

4. A corner form apparatus as defined in claim 1 wherein the predetermined angle between the face sheet and the first flange is not the same as the predetermined angle between the face sheet and the second flange.

* * * * *